United States Patent [19]

Ritter et al.

[11] 4,204,510

[45] May 27, 1980

[54] RPM GOVERNOR FOR FUEL INJECTED INTERNAL COMBUSTION ENGINES

[75] Inventors: Ernst Ritter; Reinhard Schwartz; Rolf Müuller, all of Stuttgart; Waldemar Sturm, Renningen; Werner Faupel, Gerlingen, all of Fed. Rep. of Germany

[73] Assignee: Robert Bosch GmbH, Stuttgart, Fed. Rep. of Germany

[21] Appl. No.: 830,285

[22] Filed: Sep. 2, 1977

[30] Foreign Application Priority Data

Sep. 4, 1976 [DE] Fed. Rep. of Germany ..... 2639961

[51] Int. Cl.[2] ..... F02N 17/00

[52] U.S. Cl. ..... 123/179 L; 123/140 R; 123/139 ST

[58] Field of Search ..... 123/140 MC, 140 R, 139 ST, 123/179 L, 179 G

[56] References Cited

U.S. PATENT DOCUMENTS

| | | | |
|---|---|---|---|
| 2,272,726 | 2/1942 | Sanders | 123/140 R |
| 3,640,259 | 2/1972 | Garcea | 123/140 MC |
| 3,847,127 | 11/1974 | Staudt | 123/140 R |
| 3,903,860 | 9/1975 | Maier | 123/140 R |

FOREIGN PATENT DOCUMENTS

| | | | |
|---|---|---|---|
| 185613 | 8/1955 | Austria . | |
| 2322597 | 11/1973 | Fed. Rep. of Germany | 123/179 L |
| 529671 | 11/1940 | United Kingdom . | |

*Primary Examiner*—Ira S. Lazarus
*Assistant Examiner*—Magdalen Moy
*Attorney, Agent, or Firm*—Edwin E. Greigg

[57] ABSTRACT

An rpm governor for diesel engines, with which an increased starting quantity of fuel, controlled by the rpm, is released automatically when the engine is started, but which is only released during a start when the engine is cold, and which is limited to the operational maximum when the engine is warm. The governor includes a starting device with a control lever which can be moved by the regulating member of the governor, which lever is connected to a stop which either limits the quantity to the operational maximum of releases the increased starting quantity, and to a thermostat, which causes the stop to be held in its position limiting the quantity to the operational maximum despite the control lever being activated by the regulating member.

8 Claims, 4 Drawing Figures

RPM GOVERNOR FOR FUEL INJECTED INTERNAL COMBUSTION ENGINES

BACKGROUND OF THE INVENTION

The invention concerns an rpm governor for fuel injected internal combustion engines—especially diesel engines—which has an rpm-dependent, automatic regulating member that is connected with the feed control member of the fuel injection pump by means of an intermediate lever, and which operates on the control lever of an rpm-controlled starting device only during non-operation of the governor at rpm's lower than the idling rpm. This lever is coupled to a stop, and is located in the governor housing. In the normal operational range of the governor, the stop which limits the volume to the operational maximum can be moved out of the way of a counter-stop connected to the feed control member, and the feed control member is capable of being shifted into a position, in which the fuel injection pump supplies a quantity of fuel (start quantity) which exceeds the operational maximum. The fuel injection pump is connected to a return spring which holds the control lever in its original position, not touching the regulating member, when it is not in operation.

An rpm governor is already known (Austrian Pat. No. 185,613), whose starting device controls an automatically increased starting quantity, by means of a control lever acted upon by regulating member and coupled to a stop, during non-operation of the engine and at rpm's lower than the lowest idling rpm. The increased starting quantity is cut off after the first reving of the engine and the limitation to the maximum operational quantity becomes effective. This rpm governor is employed with special effectiveness in fast starting diesel engines, but has the disadvantage that this increased starting quantity is released and controlled during every start, i.e., even when the engine is warm. Rapid starting diesel engines need, however, the increased starting quantity only in starting when the engine is below a predetermined operational temperature, so that by the use of the automatic starting device in a warm engine, too much fuel is injected, and the exhaust gases unnecessarily exceed the values for the allowable exhaust density (smog limits).

It is further known with injection pumps with rpm governors, but without automatic starting devices (FIGS. 1-3 of British Pat. No. 529,671), to limit the position of the feed control member of the fuel injection pump in the direction of greater supply quantities by stops controlled by a thermostat. These stops depend only on the temperature. The known governor contains no means for an automatic, rpm-controlled increased starting quantity release and subsequent decrease, so that the increased starting quantity is maintained too long, until the operational temperature is attained. In rapid starting diesel engines, this leads to excessive exhaust fumes.

In a special exemplary embodiment of the previously mentioned rpm governor (FIG. 4 of British Pat. No. 529,671), the stop is activated by a magnet located in the starting circuit which can be shut off by a temperature-dependent bimetallic switch. Apart from the forces that disadvantageously load the armature of the magnet, this starting device is expensive and can be unnecessarily activated by a bypass of the thermostat switch or of the starter even during operation of the motor vehicle. In this manner it may be true that a corresponding rise in performance is attained, but it also entails as an unavoidable consequence damage or destruction of the engine or of the assembly attached to the engine. In addition, during an adjustment of the maximum quantity in the governor, the position of the magnet must also be adjusted, which leads to an expensive construction.

OBJECT AND SUMMARY OF THE INVENTION

The rpm regulator according to the present invention with a combination of temperature and rpm controls, avoids the disadvantages of the known rpm governor and makes it possible in an advantageous and simple manner for an rpm governor of this type to automatically shut off the increased starting quantity of fuel when the engine is warm, even before the first reving of the engine, so that the engine can then, at most, be started at its maximum operational quantity.

A further advantage is security against tampering, because the starting process and the starting quantity decrease cannot be influenced by the driver, and above all, the starting quantity cannot be injected when the engine is in operation.

A still further advantage of this invention is the provision of an inexpensive and compact construction being accomplished by assembling the thermostat into the rpm governor either directly on the stop element, or on the control lever, for in this manner, the parts that are provided with thermostats can be pre-adjusted outside the governor as to their temperature behavior.

A starting device that is secure against tampering and overload, and is easily adjustable without influencing the other regulating functions in the governor can be achieved in an especially advantageous manner by means of the characteristics narrated hereinafter.

Because the operational temperature of the engine, that is, the corresponding temperature range can be exceeded by a large degree, in both extremes of temperature, the danger exists, that the thermostat and structural parts of the govenor can become overloaded.

The invention will be better understood as well as further objects and advantages thereof become more apparent from the ensuing detailed description taken in conjunction with the drawings.

DESCRIPTION OF THE PREFERRED EMBODIMENTS

Figure 1:
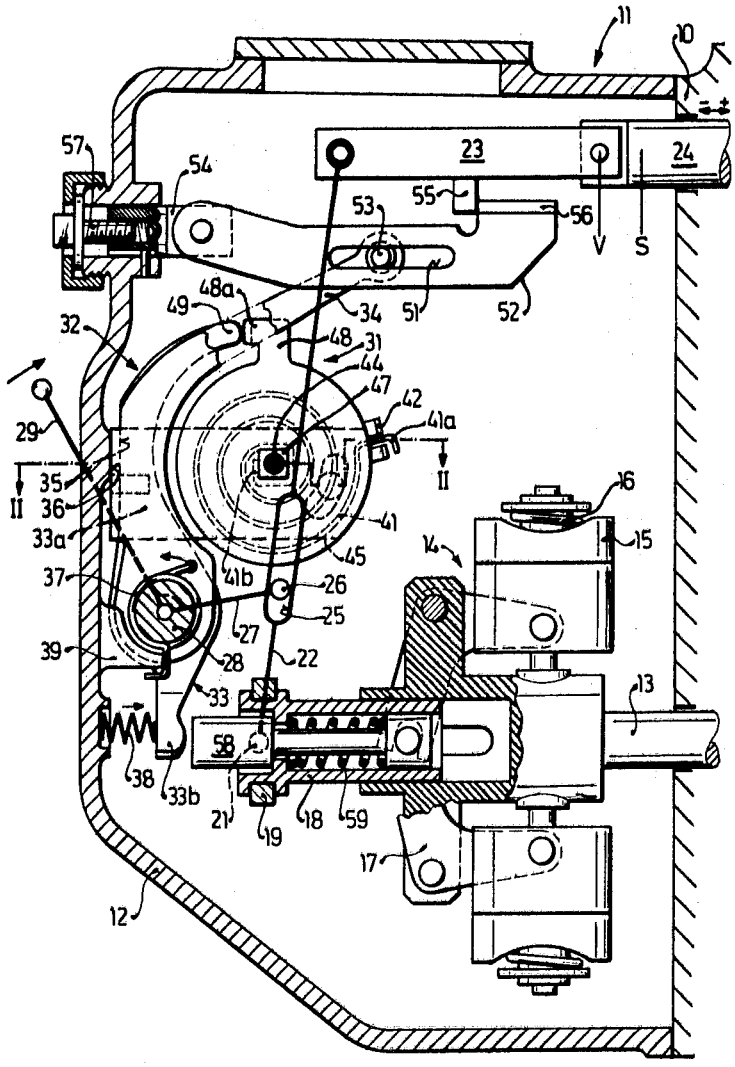
FIG. 1 is a generally cross-sectional view of the first embodiment of this invention.
Figure 2:
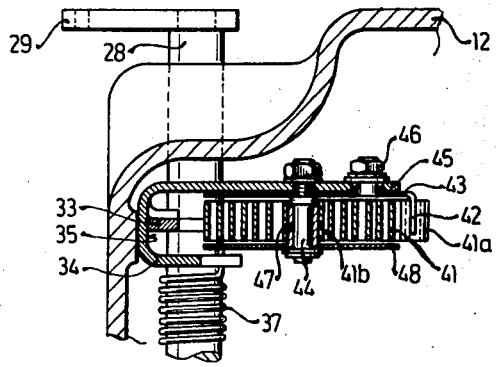
FIG. 2 is a cross-sectional view along the line II—II in FIG. 1.

Turning now to the first embodiment of this invention that is shown in FIGS. 1 and 2, the only partially shown injection pump, labeled as 10, is assembled with the governor 11 according to the invention and is flush with its housing 12. A flyweight regulator 14 of a known construction is attached to the drive shaft 13 of the injection pump 10. The centrifugal flyweight regulator 14 has flyweights 15, which move in a known manner under the effects of centrifugal force against the force of regulating springs 16, so that this regulating movement is transferred through angle lever 17 to an adapter sleeve 18 which serves as the regulating member. Coupled with the adapter sleeve 18 by means of a slide ring 19 and its pivot pin 21 is an intermediate lever 22, which is formed as a slotted lever and which connects the adapter sleeve 18 with a regulating rod 24 of the injection pump 10 which serves as the feed control member by means of a side bar 23. In this manner the regulating motions of the regulating member 18 are transferred to the regulating rod 24.

The intermediate lever 22 has a known guide bar bracket 25 with a pin 26 that is arranged to slide in the guide bar bracket 25 as the point of support. This pin 26 is part of a steering lever 27, which for its part is connected by a lever pivot 28 so as to rotate together with an adjusting lever 29 which serves as the adjusting member.

A control lever 32 is also movably mounted on the lever pivot 28 as part of a starting device 31. The control lever 32 has two coupled part levers 33 and 34, from which the first part lever 33 is formed as a double-armed lever, whose first lever arm **33*a* in the shown normal position of the control lever 32 lies against a travel stop 35 located on the second part lever 34, while the second part lever 34, formed as only a one armed lever, is pressed against a raised portion 36 of the governor housing 12 in the area of the stop 35 by the force of a return spring 37. This raised portion 36 determines the original position of the control lever 32 as shown in the drawing. The return force Pr of the return spring 37 is slightly increased by the force of a compression spring 38, which is arranged between the governor housing 12 and the second lever arm 33*b* of the first indexing arm 33, and whose function it is to hold the first part lever 33 in position against the travel stop 35 on the second part lever 34. One end of the return spring 37 is coupled with the second part lever 34 of the control lever 32. The other end is supported on a protrusion 39 of the governor housing 12. Both part levers 33 and 34 are mediately held in their illustrated normal positions by a thermostat 41, formed as a spiral, wound, bimetallic spring, when the engine is cold, that is, below a predetermined operating temperature. In this position, the first part lever 33 is held against the stop 35 of the second part lever 34. The bimetallic, thermostatic spring 41 is assembled with the control lever 32 and is thereby a part of the same. One end 41*a* of the bimetallic spring 41 is attached to a stationary support 42, which consists of a forked protrusion of a support plate 43 (see also FIG. 2). The support plate 43 is adjustable over a limited range to set the tension force Pv of the bimetallic spring 41, and is mounted on a post 44 of a receptacle 45, which is formed as a lever-shaped sheet extending from the second part lever 34 of the control lever 32, and includes both the post 44 and a positioning screw 46 for the support plate 43. While one end 41*a* of the bimetallic spring 41 is held by the stationary support 42, the other end 41*b* is secured so as to resist rotation on the perforated four-sided carrier 47 supported on the post 44. A pressure lever 48 is connected to the four-sided carrier 47 and arranged to resist rotation. The pressure lever 48 is formed as a disc in the area near the carrier 47, in order to provide an additional side guide for the bimetallic spring 41. When the engine is cold the lever arm 48*a*, which is integral with the disc-shaped part, presses with a tension force Pv1 of the bimetallic spring 41 against a resistive support surface 49 on the first lever arm 33*a* of the first part lever 33 and presses the first part lever 33 against the travel stop 35 with such force that when the regulating member 18 which acts on the lever arm 33*b* of the first part lever 33 while overcoming the force of the return force Pr of the return spring 37, will also cause both part levers 33 and 34 as well as the control lever 32 to perform a rotating motion around the axis of the lever pivot 28. During this rotating motion, a stop member 52 which is rotatably supported on a supporting piece 54 in the governor housing 12 is swung clockwise out of the way of a counter stop 55 mediately connected to the regulating rod 24 by a pin 53 which engages a guide slit 51 of the stop member 52, and which is located on the extreme end of the second indexing arm 34. The counter stop 55 in the present embodiment is carried by the side bar 23 and determines, in the position shown, the maximum load position (V) of the regulating rod 24 by its position of engagement with the stop dog 56, affixed to stop member 52. Consequently, in this maximum load position the injection pump 10 supplies the quantity of fuel that is required therefor. This maximum load position V can be adjusted by turning an adjusting screw 57 that contacts the supporting piece 54, and when the dog 56 of the stop member 52 is swung out of the way of the counter stop 55, the regulating rod 24 can be pushed into the position shown as (S) to supply an increased starting volume of fuel. When the engine is warm, that is above a predetermined temperature, the tensional force Pv of the bimetallic spring 41 lowers to a value Pv2, which is smaller than the reduced return force Pr of the return spring 37 that acts on the resistive support 49. Thus, when the engine is not operating and when the first part lever 33 which influences the lever arm 33*b* that is associated with the first part lever 33, the first part lever 33 performs a rotational motion while the pressure lever 48 is deflected. The second part lever 34 of the control lever 32 is held firmly against the raised portion 36 of the governor housing 12 by the return force Pr of the return spring 37, so that the control lever 32 does not perform a rotational motion, and so that the stop member 52 remains in its maximum load position V blocking the regulating rod 24, as shown. In this manner when the engine is warm the governor will be in its maximum load position V, thereby blocking the maximum supply quantity despite the influence of the regulating member 18 on the control lever 32**.

The regulating member 18 contains a deflecting spring 59 and a pressure bolt 58 that cooperates with the second lever arm **33*b* of the first part lever 33, so that the regulating member 18** also serves as a force accumulator, protects the governor's inner parts against overloads, and forms the necessary deflecting member when the governor is used as a variable speed governor.

Figure 3:
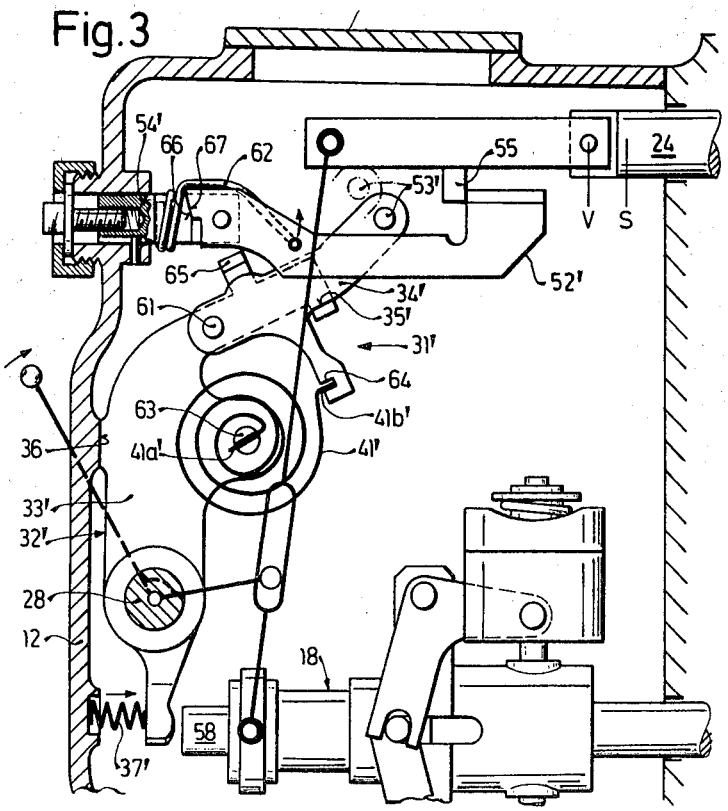
FIGS. 3 and 4 are each generally side elevational views of the second and third embodiments of this invention.
Figure 4:
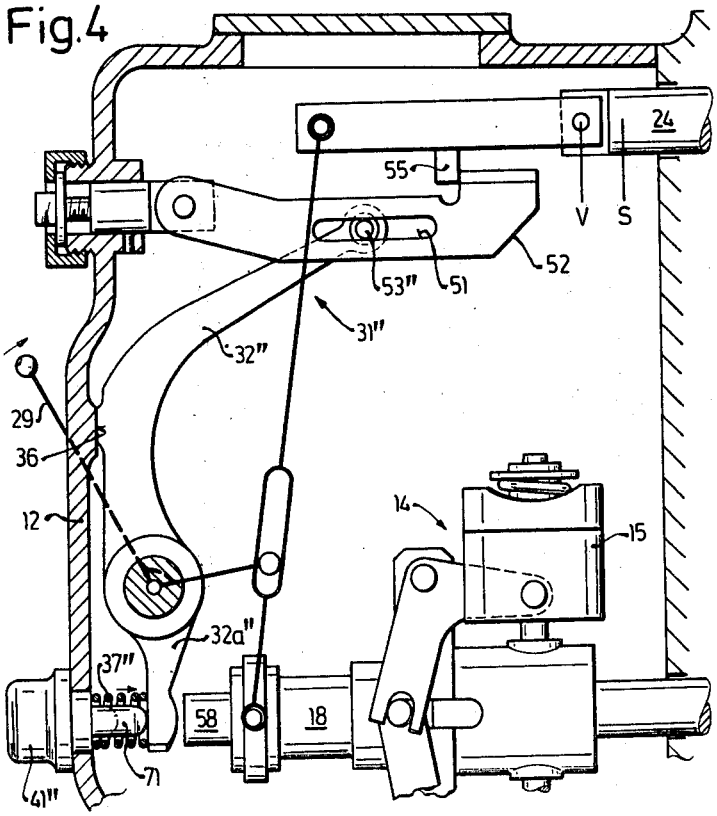

In the further exemplary embodiments of this invention according to FIGS. 3 through 5, the elements that correspond to the elements of the first exemplary embodiment of this invention are given the same reference numerals, while those that are functionally similar but include differently formed elements are given the same reference numerals, but are provided with further appropriate indicia.

The second exemplary embodiment of this invention according to FIG. 3 has in contrast to the starting device 31 of the first exemplary embodiment, a differently constructed starting device 31', which, however, operates similarly to the increasing or decreasing starting position S of the regulating rod 24. In this construction, control lever 32' rotatably mounted with a first part lever 33' on the lever pivot 28 in the governor housing 12, lies against the raised portion 36 of the governor housing 12, as shown in the drawing, and carries with it a second part lever 34' that is supported on a pivotal joint 61. When the engine is cold, the part lever 34' is held in its normal position against a first travel stop 35' by a spiral, wound bimetallic spring 41' that serves as the thermostat. In this position the regulating member 18 activates the control lever 32', whose pin 53' can rotate the stop member 52' out of the way of the counter stop 55. This occurs while overcoming the return force of a spring 62, which serves as a holding means for the stop member 52', as well as the return force of the return spring 37' that is mounted between the governor housing 12 and the first part lever 33' at the level of the regulating member 18.

The bimetallic spring 41' is connected on one end 41*a*' with a pivotal point 63 of the first part lever 33' and the other end, 41*b*', whose position is dependent on the temperature, is inserted in a slit 64 of the second part lever 34'. When the engine is warm, i.e., above a predetermined operating temperature, the bimetallic spring 41' moves the second part lever 34' into a position in which the pin 53' takes the position shown by the broken line and the second part lever 34' comes to rest against a second travel stop 65 that is connected with the first part lever 33'.

The spring 62, which serves as a holding means for the stop 52', is attached on one end to a correspondingly formed holding piece 54' and on the other terminal end is secured in the stop member 52'. The return force of the spring means 62 thereby holds the stop member 52', which has a stop dog 66, against a corresponding resistive support 67 on the holding piece 54', as shown, until a clockwise rotational motion of the control lever 32', caused by the regulating member 18, rotates the stop member 52' also clockwise, against the force of the spring 62.

In the partially dotted line position of the second part lever 34', the pin 53' does not arrive at a position of the control lever 32' because of the lost motion coupling with the stop member 52', so that the stop member 52' remains in the dotted line position blocking the maximum load position V of the regulating rod 24 even when the engine is not operating and when the regulating member 18 is acting on the control lever 32'.

In the third exemplary embodiment of this invention according to FIG. 4 the counter stop 55 of the regulating rod 24 is held by the stop member 52, as in the example in FIG. 3, in a position so as to block the maximum load setting V, when the flyweight regulator 14 and the regulating member 18 are in their corresponding positions. This continues as long as the control lever 32" of a starting device 31" remains in the position as shown and abuts the raised portion 36 of the governor housing 12. The control lever 32" is a known, one-piece, double-armed lever which is coupled by its pin 53" in the guide slit 51 of the stop member 52.

When the engine is warm, that is, above a predetermined operating temperature, a contact rod 71 associated with a thermostat 41", which is formed of an extensible material, presses against a dependent extremity or lever arm 32*a*" that is carried by the control lever 32", and which cooperates with the regulating member 18. The control lever 32" is thus blocked in the position shown and the contact rod 71 serves thereby also as a holding means for the stop member 52.

When the engine is cold the contact rod 71 remains in a shortened position shown by the dotted line and is no longer in contact with the lever arm 32*a*". In this operational condition a return spring 37" holds the control lever 32" in the position shown until, when the engine is cold or the rpm's are below the lowest idling rpm, the regulating member 18 has moved far enough to the left to allow it to act upon the lever arm 32*a*" and to rotate the control lever 32" clockwise against the force of the return spring 37". In this manner the stop member 52 is rotated out of the way of the counter stop 55 so that the regulating rod 24 can arrive in the starting position S, which is possible in the shown maximum load setting of the adjusting lever 29.

In order to prevent tampering with the thermostat 41", it is conceivable to locate it inside the governor housing 12, which is modified to receive the same, or it could be replaced by a bimetallic spring, which is supported on one end on the governor housing and on the other end on the control lever 32" (not shown).

In the following the method of operation of the governor according to the invention is described on the basis of the exemplary embodiments in FIGS. 1 through 4 with special attention given the first example described in FIGS. 1 and 2, whereby especially the method of operation of the starting device 31 will be explained.

In FIGS. 1 and 2 the adjusting lever 29 is in its maximum load setting and the flyweights 15 of the centrifugal flyweight regulator 14 are in a position which they take at an rpm above the idling rpm. In this position of the flyweights, the pressure bolt 58 of the regulating member 18 does not contact the control lever 32, and the control lever 32 remains in its original position in which it holds the stop 52 in the position limiting the travel of the counter stop 55. If the engine is shut off, and the drive shaft 13 comes to a stop, then the flyweights 15 move in a known manner in towards the axis of the drive shaft 13. The regulating member 18 is thus pushed to the left—as seen from the view in FIG. 1—over the angle lever 17 and the pressure bolt 58 presses on the lever arm 33*b* of the first part lever 33 and rotates it clockwise while the play take-up spring 38 is compressed.

When the engine is cold and the tension Pv1 of the bimetallic spring 41 is accordingly higher as compared to the return force Pr of the return spring 37 the pressure lever 48 is pressed against the resisting support 49 on the first part lever 33 so hard, that the part lever 33 is firmly pressed against the travel stop 35 on the second part lever 34, thus both part levers 33 and 34 are joined so as to practically be a united control lever 32, and this control lever 32 is rotated clockwise by the regulating member 18. The control lever 32 takes the stop 52 with it by means of the bolt 53, then rotates the stop clockwise, and the stop dog 56 of the stop 52 is taken out of contact with the counter stop 55 of the regulating rod 24. Because the pin 26 of the steering lever 27, which serves as the point of rotation for the intermediate lever 22, remains in the position shown, while the support pin 21 has moved to the left, the intermediate lever 22 also moves clockwise, moving the regulating rod 24 by means of the side bar 23, in the direction of greater fuel supply quantity into the starting position S. If the engine is running fast, the flyweights move accordingly out away from the axis of the drive shaft 13, and the regulating member 18 is pulled to the right. The intermediate lever 22 thus rotates counter-clockwise and pulls the regulating rod 24 back in the direction of smaller supply quantity. In this process, the control lever 32 also moves counter-clockwise, the pressure bolt 58 of the regulating member 18 is released from its position against the control lever 32 and the lever arm **33*b* of the first part lever 33 moves back into the position shown. The second part lever 34 follows the first part lever 33, because of the described rigid coupling, and the stop 52 moves back into the position shown. When the regulating rod 24 next moves in the direction of greater injection quantity (+), the counter stop 55 can only move as far as the shown maximum load setting, limited by the stop 52**.

If the same starting procedure occurs when the engine is warm, then the tension force Pv2, as already described above, of the bimetallic spring 41 is decreased so much, that when the first part lever 33 is rotated clockwise by the control movement from the regulating member 18, the pressure lever 48 moves away, while the second part lever 34 remains against the raised portion 36 of the governor housing 12 because of the correspondingly greater return force Pr of the return spring 37. In this manner the stop 52 also remains in the position shown, blocking the maximum load setting V and the engine receives no starting quantity greater than the maximum operational quantity. By this means, the bothersome smoke cloud that appears when a warm engine is started, is avoided.

In the second exemplary embodiment of this invention, according to FIG. 3, when the engine is warm, the changed position of the pin 53' prevents the feed of an increased starting quantity of fuel.

In the third exemplary embodiment of this invention, according to FIG. 4, the feed of an increased starting quantity of fuel is prevented by the contact rod 71 of the thermostat 41'', which acts on the lever arm **32*a*'' of the control lever 32'', because both the control lever 32'' and the stop 52, which is firmly coupled with the control lever 32'', remain in their shown positions, blocking the maximum load setting. In this manner the pressure bolt 58 can only be moved by the flyweights 15 until it abuts the lever arm 32*a*'**, which brings no material disadvantages.

If the contact rod 71 is in its position shown as a broken line, then when the engine is not operational the control lever 32'' can be rotated counter-clockwise, rotating the stop 52 by means of the pin 53'', and moving the stop 52 out of the way of the counter stop 55, so that the regulating rod 24 can reach the starting position S.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An rpm governor for fuel injected internal combustion engines such as diesel engines including a fuel injection pump having a fuel supply adjusting member comprising, a housing, an automatically adjustable, remdependent regulating member, an intermediate lever for connecting said regulating member with the fuel supply adjusting member of the fuel injection pump, a counter stop connected to said fuel supply adjusting member, a stop member movable into a position for engagement with said counter stop to limit the maximum fuel supply quantity in the normal operational range of said regulating member, an rpm-controlled starting device including a control lever mounted in said housing and coupled with said stop member said regulating member being arranged to engage said control lever when the governor is not operating or when the engine is operating at an rpm below the minimum idling rpm, said stop member being pivotally articulated on said housing and coupled to said control lever, a return spring for yieldingly holding said control lever in its normal position when it is non-engaged by said regulating member, said starting device including a thermostat which is connected with said control lever whereby at least a part of said control lever engages said stop member which is held in a position for limiting the travel of said counter stop when the engine is above a predetermined operating temperature, means for holding said stop member in said counter stop travel limiting position including when said control lever is engaged by said regulating member, said thermostat being arranged to allow movement of said stop member into a position out of engagement with said counter sotp for permitting said control lever to be acted upon by said regulating member to provide an increased starting fuel quantity when the engine is cold.

2. An rpm governor according to claim 1 wherein said thermostat is integral with said control lever and wherein said control lever includes a first part lever and a second part lever, said regulating member being arranged to engage said first part lever, said first part lever operatively associated with said regulating member and said second part lever operatively associated with said stop member, a travel stop on said second part lever, said first and second part levers being coupled together by said thermostat whereby when said engine is cold said first part lever is retained in engagement with said travel stop, said first and second part levers being adjustable into a position, when said engine is warm, wherein said stop member is retained in said counter stop travel limiting position irrespective of the engagement of said regulating member with said first part lever.

3. An rpm governor according to claim 2 including a shaft in said housing for supporting said first and second part levers, said second part lever comprising a one-armed lever having said travel stop, said first part lever comprising a two-armed lever including a first and second lever arm, said travel stop being arranged to determine a normal position for said control lever and against which said first lever arm of said first part lever is yieldingly engaged at least mediately by said thermostat when said engine is cold, said travel stop disposed in parallel relationship with said second part lever, said second lever arm of said first part lever adapted to be acted upon by said regulation member.

4. An rpm governor according to claim 3 including a receptacle on said second part lever for said thermostat, said thermostat comprising a bimetallic spring, said receptacle including a stationary support for one end of said bimetallic spring and a pressure lever connected with the other end of said bimetallic spring, a resisting support on said first lever arm of said first part lever, said pressure lever being pressed against said resisting support surface, with a temperature-dependent tensional force (Pv) that is controlled by said thermostat, said second part lever positively connected to said stop member engages with said return spring supported on said housing whereby said return spring comprises holding means.

5. An rpm governor according to claim 3 wherein the tensional force of said thermostat for coupling said two part levers together is greater when the engine is cold and smaller when the engine is warm than the return force of said return spring.

6. An rpm governor according to claim 3 wherein said stationary support is adjustably disposed relative to said receptacle on said second part lever.

7. An rpm governor according to claim 3 wherein said thermostat comprises a spirally wound bimetallic spring.

8. An rpm governor for fuel injected internal combustion engines according to claim 1, in which said first part lever is supported on a shaft means in said governor hosuing and further includes an articulated joint and plural blocking means for said second part lever, said thermostat having terminal end portions, one of which is pivotally attached to said first part lever and the other end portion being pivotally attached to said second part lever.

* * * * *